United States Patent [19]

Ireton

[11] Patent Number: 5,070,783

[45] Date of Patent: Dec. 10, 1991

[54] ADJUSTABLE DOCTOR BLADE MOUNTING MEANS

[76] Inventor: Carl A. Ireton, 3189 Sunny Crest La., Kettering, Ohio 45419

[21] Appl. No.: 524,795

[22] Filed: May 18, 1990

[51] Int. Cl.[5] ..... B41F 31/00

[52] U.S. Cl. ..... 101/349; 101/157

[58] Field of Search ..... 101/349, 350, 148, 207, 101/157, 169; 118/261

[56] References Cited

U.S. PATENT DOCUMENTS

| | | | |
|---|---|---|---|
| 2,898,855 | 8/1959 | Richter | 101/425 |
| 2,931,297 | 4/1960 | Coudriet | 101/157 |
| 3,006,275 | 10/1961 | Allen | 101/157 |
| 3,131,415 | 5/1964 | Dapses | 101/157 |
| 3,780,670 | 12/1973 | Abler et al. | 101/169 |
| 4,699,056 | 10/1987 | Beck | 101/157 |
| 4,892,035 | 1/1990 | Terzuolo | 101/148 |
| 4,938,131 | 7/1990 | Maggi | 101/169 |

*Primary Examiner*—Edgar S. Burr
*Assistant Examiner*—Ren Yan
*Attorney, Agent, or Firm*—Shlesinger Arkwright & Garvey

[57] ABSTRACT

This invention shows a reverse angle doctor blade adapted to be adjustably mounted to cooperate with the anilox roll of a flexographic printing press. The doctor blade is carried in an arcuate holder and may be adjusted angularly relative to the anilox roll in the arcuate seat and the arcuate holder itself can be adjusted toward and away from the anilox roll to control the exact parallel positioning of the doctor blade's edge against the surface of the roll.

7 Claims, 1 Drawing Sheet

ADJUSTABLE DOCTOR BLADE MOUNTING MEANS

This invention relates to a doctor blade means for an inking roller for a printing press and more particularly to adjustable mounting means and a replaceable cartridge for supporting a doctor blade for use with an anilox inking roller in a flexographic type printing press.

BACKGROUND

The following U.S. Patents show examples of doctor blade means with which this invention is concerned.

U.S. Pat. No. 3,822,642 to Grindeland July 9,1974:

U.S. Pat. No. 4,151,797 to Dunsirn May 1,1979;

U.S. Pat. No. 4,329,936 to Heist et al May 18,1982; and

U.S. Pat. No. 4,796,549 to Okamura Jan. 10 1989.

As shown in these cited patents, various types of doctor blade means are well known for use against the surfaces of inking rollers used in the printing presses. The purpose of and the functioning of doctor blades against these rolls in the printing trade are well known and this invention provides an improved blade mounting means in combination with an adjustable supporting means for an easily replaceable doctor blade structure.

BRIEF DESCRIPTION OF THIS INVENTION

The novel combination of a doctor blade cartridge having a cylindrical body for holding the doctor blade, permits the cartridge to be mounted in an arcuately shaped seat to make it possible for quickly and easily replacing the doctor blade when a worn blade must be replaced or a blade having different operating characteristics is needed. The cylindrical body can be easily adjusted in its arcuate support to vary the angle of the blades bearing against the inking roller and the arcuate seat is carried on its support by adjustable means that permit the blade to be moved closer or farther away from the inking roller and includes means for adjusting the opposite ends of the doctor blade independently toward or away from the roller.

The cartridge itself is constructed and arranged to have a relatively wide slot that extends lengthwise along its periphery that is provided to accommodate a wide variety of different types of doctor blades. The particular blade to be mounted in the slot can be easily positioned in the slot and a gib that extends the length of the slot can be tightened in place to firmly fix the doctor blade in the cartridge.

IN THE DRAWINGS

DETAILED DESCRIPTION

The reverse angle doctor blade of this invention is preferably provided for use with the anilox inking roll of a flexographic printing press. This blade is provided for engagement against this roll for the purpose of stripping any excess ink from the surface of this roll before it rolls into contact with the printing plates of the press.

Figure 1:
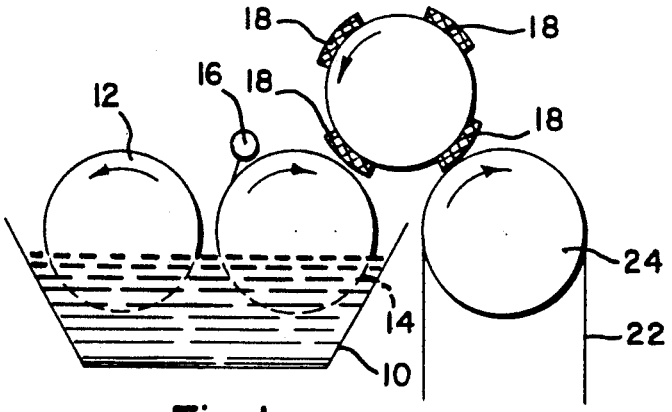
FIG. 1 is a diagrammatic representation of a flexographic printing press.
Figure 3:
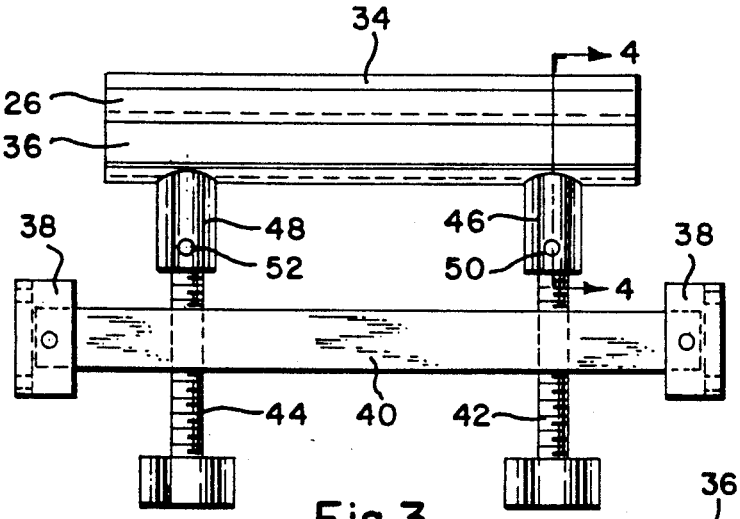
FIG. 3 is a bottom view of the mounted cartridge.

A diagramatic showing of such a flexographic press is shown in FIG. 1. The inking means for the press includes the ink supply pa 10 that cooperates with a roller 12 that carries ink from the pan to be rolled onto the surface of the inking roller 14. As the inking roller continuously rotates in a clockwise direction as shown in the diagram, the inking roller is engaged first by the ink supply roller and then the freshened surface of the inking roller 14 passes up to the reverse angled doctor blade means 16. This blade is lightly pressed against the surface of the inking roller 14 and any excess ink on the surface is skimmed off to be flushed back into the ink supply pan 10. As the roll 14 continues its rotation, the doctored surface of the inking roll 14 rolls against the surfaces of the several printing plates 18 carried on the surface of the printing roller 20. The ink on the doctored surface of the inking roll is transferred onto the surfaces of the printing plates as they roll against the inking rol1 14. After the printing plates have been inked by their rolling contact with the doctored surface of the anilox roller, they are pressed into printing contact with a web of paper 22 or other material to be printed that is carried on the roller 24.

All of these basic elements of a flexographic printing press are well known in the printing arts and this invention is concerned with the specific structure of the doctor blade holder and its mounting means. The novel feature of this disclosure is built into the means for adjustably positioning the blade in its optimum position at all times relative to the inking roller for properly controlling the residual layer of ink that remains on the surface of the anilox printing roller 14 after it is coated with an excess layer of ink as it leaves the area of its contact with the ink supply roller and the doctor blade stations, and the structure of the blade holder itself.

Figure 2:
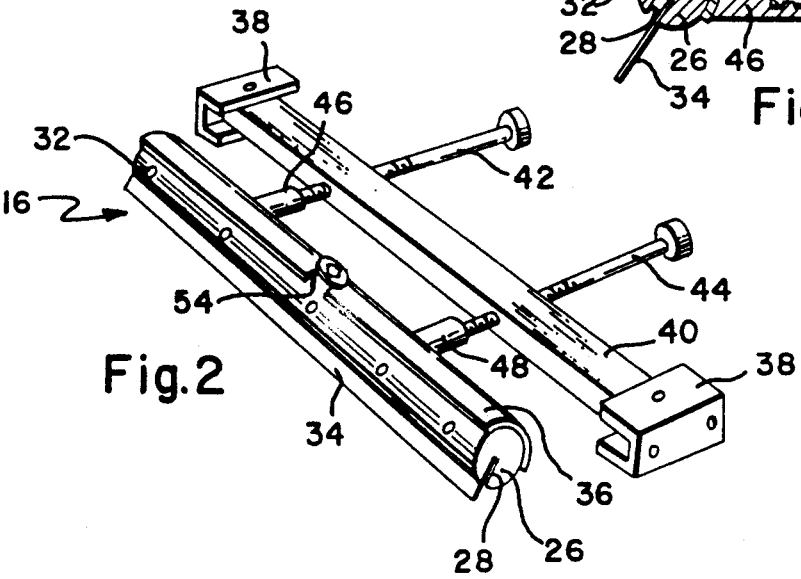
FIG. 2 is top perspective view of a doctor blade cartridge mounted in its seat that is carried on means for adjusting the doctor blade.

As best seen in FIG. 2, the doctor blade assembly 16 includes a cartridge or blade holder 26 that takes the form of a cylindrical body which has a longitudinally extending slot 28 therein that passes from end to end of the body 26. The slot has a width to contain a gib 30 that extends the full length of the slot, the gib being tightly held in its position in the slot by a plurality of set screws 32. The gib is so situated as to firmly clamp a doctor blade for example blade 34 in the slot to project outwardly therefrom to be engaged against the surface of the inking roll 14 at a reverse angle as shown in FIG. 1.

The cylindrical body of the doctor blade cartridge is supported in an arcuately shaped seat 36. The seat extends across the inking station near the anilox inking roll 14 and is supported from fixed supports 38 that may be fixed to the opposite sides of the frame of a printing press having rolls as wide as from 80" to as long as 100". These support means 38 carry a rigid bar 40 that reaches from one support to the other but in a narrow press in a range of from 6" to 10", the bar 40 can be a cantilever beam supported from only one side of the frame of the press.

Figure 4:
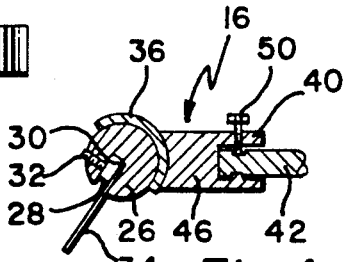
FIG. 4 is a sectional view taken on line 4—4 of FIG. 3.

The arcuate seat is mounted on the bar 40 by the threaded rods 42 and 44 . The arcuate seat has coupling sockets 46 and 48 integral therewith that are designed to engage around the ends of the rods 42 and 44 respectively and set screws 50 and 52 are provided to engage in slots at the ends of rods 42 and 44 as best seen in FIG. 4. The ends of the rods have a degree of movement within the sockets until the set screws 50 and 52 are tightened down.

The arcuate seat, about midway of its length, has a slot 54 cut into it that cooperates with a set screw 56 carried by the cartridge 26. The slot and screw 56 cooperate to fix the cartridge in any desired relatively rotated position of the cartridge in the seat to position the doctor blade that is carried by the cartridge, at any desired angle within the working range of the doctor blade with respect to the anilox roller.

The above described mounting structure provides a solid support for firmly holding the doctor blade in its operative position with its exposed edge pressed lightly but firmly in contact across the width of the anilox roll. It is essential that the blade have the proper light touch with just the right degree of flexible pressure of the edge of the blade along a line of contact, to strip the excess ink from the surface of the anilox roll without producing any undue wear against the surface of the roll. When a new blade is to be mounted in the seat, it must be positioned properly for making such contact and this mounting means includes a three way adjustability to ensure the proper alignment of the blade's edge against the roll at all times.

The position of the cartridge in the seat can be fixed in any desired rotated position as suggested above by the adjustment controlled by the set screw 56. The arcuate seat 36 can be adjusted toward or away from the anilox roll by the simultaneous rotation of both of the threaded rods 42 and 44. If necessary the opposite ends of the arcuate seat may be adjusted individual toward or away from the anilox roller by rotation of one or the other of the threaded rods. When this last mentioned adjustment is to be made the set screws 50 and 52 in the sockets 46 and 48 are loosened so that the ends of rods 42 and 44 may move slightly with respect to the sockets as the one end moves relative to the other end. Thus a newly mounted cartridge or a slightly worn blade can, in effect, be positioned as if carried in a mounting having a universal adjustability with respect to the surface of the anilox roll against which the exposed edge of the doctor blade must be engaged with a light resilient pressure.

It is to be noted that any one of a number of interchangeable cartridge elements can be provided and held in reserve for a quick change when necessary and any one of the interchangeable cartridge elements 26 can be fitted with any one of a variety of different types of doctor blades. The wide slot 28 that contains the gib 30 can hold a thin steel doctor blade or a thin plastic blade such as are conventionally used for such a purpose, In addition a combination of a very flexible doctor blade together with a stiffener blade may be assembled in the slot and held firmly in place with the gib when it is tightened in place. Plastic and rubber doctor blades either alone or together with stiffeners can similarly be supported in the widened slot 28 to make it possible to quickly interchange the type of doctor blade to be used in a particular press or to quickly change a worn blade for a new one without shutting down the press for any longer than it takes to mount a replacement cartridge in the seat 36 and make the necessary adjustment that may be needed to position the edge of the doctor blade pressed properly against the anilox roll.

While the above description covers the preferred form of this invention , it is possible that modifications thereof may occur to those skilled in the art that will fall within the scope of the following claims.

I claim:

1. An improved doctor blade mounting blade for a reverse angle doctor blade for use with a flexographic printing press including a plate roll, an anilox roll, a doctor blade, an interchangeable cartridge for supporting said blade and mounting means for carrying said interchangeable cartridge, said doctor blade having a generally planar body with an exposed edge adapted to be engaged at a reverse angle against the periphery of the anilox roll, said cartridge being supported in said mounting means to carry said doctor blade in a proper position for allowing said edge to coact along a line of contact with the periphery of said roll comprising a fixed support means upon which said mounting means is carried, said cartridge for said doctor blade being held by said mounting means in a spaced relationship to the periphery of the printing roll, said mounting means including means to adjust the position of said cartridge relative to the peripheral surface of said roll, said cartridge having a cylindrical body for carrying the doctor blade, said mounting means having an arcuately shaped seat for cooperating with and supporting said cylindrical body of said cartridge, said means to adjust being operative to move said seat relative to said roll to hold the exposed edge of said doctor blade in a position substantially parallel to the axis of rotation of the roll and to hold said edge in operative contact with the surface of said roll, and said means to adjust also including means for fixing said cylindrical body of said cartridge in a desired rotated position in said seat to fix said doctor blade at a desired reverse angle relative to the surface of said roll at the line of contact of the edge of the doctor blade with said anilox roll.

2. A doctor blade means as in claim 1 wherein said cartridge can be rotated in said seat to a desired position in and then fixed to said arcuate seat to control the angular position of the doctor blade relative to the periphery of the roll.

3. A doctor blade means as in claim 1 wherein said arcuate seat is supported from said fixed support in the nip formed between the anilox inking roll and the plate roll by a pair of spaced apart threaded means for adjusting the position of the cartridge relative to the periphery of the anilox roll.

4. A doctor blade means as in claim 1 wherein said cartridge is rotatably mounted in said arcuate seat, means to fix said cartridge in said seat in a desired rotated position whereby to hold said blade in a proper adjusted angular position relative to the periphery of the roll.

5. A doctor blade means as in claim 1 wherein said arcuate seat includes a slot that lies in a plane that is perpendicular to the axis about which said anilox roll rotates, set screw means cooperating between said slot and said cartridge to permit said cartridge to be first rotated to a desired position, and then fixed in place whereby to position said doctor blade at said desired angular position against the periphery of the roll.

6. A doctor blade as in claim 1 wherein said interchangeable cartridge that has a cylindrical body is removably attached to said arcuate seat whereby a worn doctor blade can be easily removed and quickly replaced with another cartridge and its doctor blade.

7. A doctor blade means as in claim 1 wherein said ink supply roll has a rolling coact with the anilox roll and said anilox roll has a rolling contact with said plate roll, and said mounting means and said arcuate seat are supported above the nip formed between the ink supply roll and said anilox roll and below the nip formed between the anilox roll and the plate roll whereby to position said reverse angle doctor blade in a position to coact with the surface of the anilox roll before it rolls into contact with said plate roll.

* * * * *